United States Patent [19]

Klaessig et al.

[11] 4,263,092

[45] Apr. 21, 1981

[54] METHOD FOR TREATING BLACK LIQUOR USING ACRYLIC ACID POLYMER

[75] Inventors: Frederick C. Klaessig, Doylestown, Pa.; Donald F. Jacques, Kingwood, Tex.

[73] Assignee: Betz Laboratories, Inc., Trevose, Pa.

[21] Appl. No.: 66,952

[22] Filed: Aug. 16, 1979

[51] Int. Cl.[3] ..... P21C 11/00

[52] U.S. Cl. ..... 162/48; 159/47 WL; 162/30 K; 162/72; 203/7

[58] Field of Search ..... 210/58; 203/7; 159/47 WL; 162/30 K, 72, 199, 48; 252/180

[56] References Cited

U.S. PATENT DOCUMENTS

| | | | |
|---|---|---|---|
| 3,293,152 | 12/1966 | Herbert | 203/7 |
| 3,514,376 | 5/1970 | Salutsky | 203/7 |
| 3,516,910 | 6/1970 | Engman et al. | 159/47 WL |
| 3,766,077 | 10/1973 | Hwa et al. | 210/58 |

*Primary Examiner*—Peter Chin

*Attorney, Agent, or Firm*—Alexander D. Ricci

[57] ABSTRACT

A method is disclosed for inhibiting soft scale precipitation in black liquor systems by adding thereto polyacrylic acid.

11 Claims, No Drawings

METHOD FOR TREATING BLACK LIQUOR USING ACRYLIC ACID POLYMER

TECHNICAL FIELD

The kraft process is presently the dominant pulping process in the United States. Besides improved pulp characteristics, a primary factor for this dominance lies in the ability of kraft pulpers to lower chemical costs by maintaining an efficient chemical recovery cycle.

The kraft process recovery cycle consists of several steps in regenerating the cooking liquor (used in the digestion of wood) from the spent liquor. At the blow pit one has a mixture of wood pulp and spent cooking liquor. The spent liquor contains lignin and other wood components dissolved during digestion and also contains inorganic materials such as sodium sulfate and sodium carbonate. The organic components give the spent cooking liquor a dark color, hence the name black liquor. Black liquor, when separated from the pulp at the washers, has a concentration of about 15% total solids and must be concentrated to about 65% total solids if the liquor is to be efficiently burned in a recovery furnace. Multiple-effect and direct contact evaporators concentrate the liquor to 65% solids at which point the liquor is sprayed into a recovery furnace where further dehydration of the liquor and combustion of the liquor solids occur. Heat is recovered from the lignins and other organic components and, under the extreme temperature conditions found in the recovery furnace, the inorganic sodium sulfate is reduced to sodium sulfide. The inorganic components are recovered as a molten ash (termed smelt) which can be dissolved in water and causticized to give regenerated cooking liquor.

Though each element in the recovery cycle is important to the efficient operation of a kraft pulp mill, the recovery furnace occupies the central position. Recovery furnaces were first developed solely to reclaim the expensive sodium based chemicals, but through updated designs and improved techniques the recovery furnace has become an important source of steam to the pulp mill. Efficient operation of the recovery furnace is critical not only to the recovery cycle, but also to the energy consumption of the kraft pulp mill. For an efficient utilization of the recovery furnace, a maximum amount of residual solids should be recovered from the digester, washers and evaporators.

Multiple-effect evaporators are ordinarily operated by employing the steam produced in the highest pressure evaporator to heat the next highest pressure evaporator. The flow of liquor is counter-current to the flow of steam. The effects of an evaporator train are commonly numbered according to steam flow, thus effect I receives the highest temperature steam and the most concentrated black liquor. Weak black liquor entering the multiple-effect evaporator will range in concentration between 12 and 20% total solids and the strong black liquor leaving the evaporators will range in concentration between 40 and 50% total solids.

Multiple-effect evaporators are most efficient in concentrating black liquor up to about 50% total solids. Although scaling can occur at less than 50% solids, above this value the evaporators are prone to severe scaling, leading to the utilization of direct contact evaporators immediately prior to the recovery furnace.

A common problem which arises with the use of black liquor evaporators is the formation of soft scale (water soluble inorganics) deposits on evaporator surfaces. Soft scale interferes with evaporator operations first by decreasing heat transfer between the steam and black liquor and second by physically blocking evaporator tubes. With severe soft scale fouling, the evaporator must be removed from production and cleaned by a water boil-out.

A combination of literature review, field evidence and laboratory studies has led to the determination that the mineral burkeite, a double salt of sodium sulfate and sodium carbonate, best represents soft scale found in black liquor evaporators.

DESCRIPTION OF THE INVENTION

The present invention is drawn to a method for inhibiting the precipitation of soft scale from an aqueous medium prone to soft scale precipitation. Of course, this method is considered to be particularly useful as it relates to inhibiting soft scale deposit formation on surfaces of multiple-effect black liquor evaporators and will, accordingly, be described herein as it relates to that environment.

According to the present invention, the formation of soft scale deposits in black liquor evaporators is inhibited by adding to the black liquor an effective amount for the purpose of polyacrylic acid (PAA) or water-soluble salt thereof.

Acrylic acid polymers are well known as are methods for preparing them, as evidenced by the "Encyclopedia of Polymer Science and Technology", Volume 1, John Wiley & Sons, Inc., Library of Congress Catalog Card Number 64-22188, 1971, pp. 197–204. This work is incorporated herein by reference. Since polymers representative of a broad spectrum of molecular weights were tested and demonstrated efficacy, successful use of a soft scale treatment according to the present invention is not believed to be particularly molecular weight-dependent. In any event, it is believed that the lower limit would be about 500. The preferred lower molecular weight limit is about 1,500 with the most preferred being about 5,000. As long as the polyacrylic acid is water-soluble, it will be efficacious for the purpose. Based on this consideration, the molecular weight could be as high as about 1,000,000 with about 100,000 being the most preferred upper limit. As noted above, the acid or water-soluble salt form of the polymer would be effective. Examples of these polyacrylic acid salts would be sodium, ammonium or potassium salts. Any reference herein to polyacrylic acid is, accordingly, intended to include the water-soluble salts.

Depending on the nature and severity of the particular problem being treated, the amount of active polymer added could vary over a wide range. Active dosages could be as low as about one part active polymer per million parts of black liquor, based on weak liquor flow. About 25 parts per million is the preferred minimum, with about 50 parts per million being most preferred. On the other hand, active dosages could be as high as about 500 parts per million. About 350 parts per million is the preferred maximum, with about 300 parts per million being most preferred.

The polymers are believed to be effective when added to any stage of the multiple-effect black liquor evaporator. Generally, however, it is preferred to add them to the first effect.

EXAMPLE 1

According to U.S. Pat. No. 3,516,910 to Engman et al, substituted polyacrylates are effective soft scale deposit inhibitors in black liquor evaporators as allegedly demonstrated by testing sodium polymethacrylate. A comparison of these materials (as represented by sodium polymethacrylate) with the unsubstituted form of polyacrylic acid according to the present invention was provided using the following test procedures:

Materials:

29.92 g sodium carbonate
11.08 g sodium sulfate
100.0 g DD water
0.7 ml treatment (1% active)

(1) Dissolve materials in 250 ml Erlenmeyer flask.

(2) Heat to approximately 90° C. and maintain temperature for one hour.

(3) Add 10 g sodium chloride.

(4) Agitate manually upon addition of the salt, after 20 minutes and 40 minutes, otherwise gyratory action of water bath shaker should be used.

(5) Filter.

(6) Dry precipitate overnight and weigh.

The precipitate formed in this test was burkeite which, as noted above, is considered to be the predominant constituent of soft scale. Burkeite is the double salt of sodium sulfate and sodium carbonate. In the test (as in all reported burkeite tests), the molar ratio of sodium sulfate to sodium carbonate in solution was chosen to be 0.28, which conforms to the average molar ratio of 28 kraft mill black liquor samples analyzed and reported by T. M. Grace et al, TAPPI Conference Papers, "Alkaline Pulping and Testing", Sept. 13-15, 1976, Dallas, TX, pp. 85-89.

The comparative results are reported below in Table 1 in terms of grams of precipitate remaining after treatment. Since the test conditions are considered to be rather harsh, the results are seen to be inconclusive concerning the inhibition efficacy of each material as compared to control (8±1 g). However, comparative results are, nonetheless, considered to be valid.

The polyacrylic acids tested were Good-rite polymers available from B. F. Goodrich and had reported molecular weights as indicated parenthetically. The sodium polymethacrylates tested were obtained from two different suppliers. Treatment dosages were 50 parts per million (actives).

TABLE 1

COMPARISON OF POLYACRYLIC ACIDS WITH SUBSTITUTED POLYACRYLATES

| Teatment | Weight Precipitate (g) |
|---|---|
| Sodium Polymethacrylate I | 8.1 |
| Sodium Polymethacrylate II | 9.6 |
| Polyacrylic Acid (M.W. = 100,000) | 7.1 |
| Polyacrylic Acid (M.W. = 5,000) | 6.6 |
| Polyacrylic Acid (M.W. = 1,500) | 8.2 |

As a whole, the polyacrylic acids compared favorably with the sodium polymethacrylate which, as already noted, is disclosed in the prior art as a soft scale inhibitor for black liquor evaporators.

EXAMPLE 2

Tests were conducted to determine the efficacy of polyacrylic acid and other known general dispersants as soft scale precipitation inhibitors using a testing procedure as follows:

Materials:

29.92 g sodium carbonate
11.08 g sodium sulfate
100 g DD water
10 g sodium chloride (1) Dissolve sodium carbonate and sodium sulfate in water in a 250 ml Erlenmeyer flask.

(2) Add 10 g sodium chloride and dissolve.

(3) Add treatment.

(4) Lightly stopper flask, place in gyratory bath at 90° C. and heat for 3 hours.

(5) Filter.

(6) Dry burkeite precipitate overnight at 105° C. and weigh.

Results of these tests are reported below in Table 2 in terms of weight of precipitate remaining after treatment and percent (%) inhibition as compared to a no-treatment control in which 7.7±1.3 g of precipitate formed. Treatment levels were all 200 ppm actives. The conditions of these tests were not considered to be as harsh as those reported in Example 1 such that the results in Table 2 are considered to more accurately reflect soft scale inhibition efficacy. The other known general dispersants tested were a sulfonated polyfunctional oligomer and an alkylaryl polyethylene glycol ether (both commercially available).

TABLE 2

SOFT SCALE INHIBITION EFFICACY OF POLYACRYLIC ACID POLYMERS AND OTHER KNOWN GENERAL DISPERSANTS

| Treatment | Weight Precipitate | % Inhiibition |
|---|---|---|
| PAA (M.W. = 100,000) | 1.6 | 79 |
| PAA (M.W. = 5,000) | 0.4 | 95 |
| PAA (M.W. = 1,500) | 1.7 | 78 |
| Oligomeric Dispersant | 5.5 | 29 |
| Glycol Ether Dispersant | 6.5 | 16 |

Indeed, the PAA's reported in Table 2 were seen to demonstrate significant soft scale inhibition efficacy. On the other hand, despite the fact that the other compounds tested are known as general dispersants, they failed to inhibit soft scale precipitation.

EXAMPLE 3

Soft scale inhibition of PAA as a function of treatment level was also studied using the procedure described in Example 2.

The results of this test are reported below in Table 3 in terms of weight of precipitate remaining after treatment and percent (%) inhibition as compared to a no-treatment control. The control yielded 7.7±1.3 g of precipitate.

TABLE 3

SOFT SCALE INHIBITION AS FUNCTION OF TREATMENT LEVEL

| Treatment | Dosage (active ppm) | Weight Precipitate (g) | % Inhibition |
|---|---|---|---|
| PAA (M.W. = 100,000) | 10 | 4.6 | 40 |
| | 25 | 3.4 | 56 |
| | 50 | 2.3 | 70 |
| | 100 | 0.3 | 96 |
| PAA (M.W. = 5,000) | 10 | 4.9 | 36 |
| | 50 | 4.3 | 44 |
| | 100 | 4.5 | 42 |
| | 150 | 2.2 | 71 |

TABLE 3-continued

SOFT SCALE INHIBITION AS FUNCTION OF TREATMENT LEVEL

| Treatment | Dosage (active ppm) | Weight Precipitate (g) | % Inhibition |
|---|---|---|---|
| | 200 | 0.4 | 95 |
| PAA (M.W. = 1,500) | 10 | 7.7 | 0 |
| | 50 | 7.0 | 9 |
| | 100 | 6.6 | 14 |
| | 200 | 1.7 | 78 |

EXAMPLE 4

As already noted, the predominant constituent of soft scale is considered to be burkeite, a double salt of sodium sulfate and sodium carbonate. Burkeite might best be represented by the chemical formula $2NaSO_4.Na_2CO_3$. Due to variations in soft scale compositions, it is believed that other possible minor constituents of soft scale are thermonatrite, $Na_2CO_3.H_2O$ and thenardite ($Na_2SO_4$). Accordingly, polymer according to the present invention was tested for inhibition efficacy against these possible constituents.

The procedure for the thermonatrite test was as follows:

Materials:

35 g sodium carbonate
12 g sodium chloride
100 g DD water (1) Dissolve sodium carbonate in DD water in 250 ml Erlenmeyer flask.

(2) Dissolve sodium chloride in above solution.

(3) Add treatment.

(4) Stopper flask and place in gyratory bath at 90° C. for 3 hours.

(5) Filter precipitate and dry overnight at 105° C.

(6) Weigh dried precipitate and calculate % inhibition (dried weight $\times$ 1.18 = $Na_2CO_3.H_2O$ weight).

The thenardite inhibition test procedure was as follows:

Materials:

30 g sodium sulfate
12 g sodium chloride
100 g DD water (1) Dissolve sodium sulfate into DD water in 250 ml Erlenmeyer flask.

(2) Dissolve sodium chloride into above solution.

(3) Add treatment.

(4) Adjust pH to 11.5.

(5) Stopper flask and place in gyratory bath at 90° C. for 3 hours.

(6) Filter precipitate and dry overnight at 105° C.

(7) Weigh dried precipitate and calculate % inhibition.

The results of these tests are reported below in Table 4 in terms of percent (%) inhibition as compared to a control. Treatment levels were 200 parts per million.

TABLE 4

INHIBITION OF THERMONATRITE AND THENARDITE WITH POLYACRYLIC ACID

| Precipitate | Treatment | % Inhibition |
|---|---|---|
| Thermonatrite | PAA (M.W. = 5,000) | 93 |
| | PAA (M.W. = 100,000) | 98 |
| | PAA (M.W. = 1,500) | 93 |
| Thenardite | PAA (M.W. = 5,000) | 70 |
| | PAA (M.W. = 100,000) | 16 |

TABLE 4-continued

INHIBITION OF THERMONATRITE AND THENARDITE WITH POLYACRYLIC ACID

| Precipitate | Treatment | % Inhibition |
|---|---|---|
| | PAA (M.W. = 1,500) | 42 |

As can be seen from Table 4, PAA was particularly efficacious against thermonatrite. Accordingly, the polymer could additionally be used in soda ash recovery plants and paper mills which do not use sodium sulfate in the cooking liquor.

EXAMPLE 5

Other chemical species found in black liquor are solid calcium carbonate and fatty acids. Accordingly, these species were added to the burkeite system of Example 2 and tested for their effect on the burkeite inhibition efficacy of PAA. Also, a sample of black liquor was obtained and tested in a similar burkeite system.

It has been determined that solid calcium carbonate is found in kraft black liquor in amounts less than 450 parts per million. However, an extremely high level of calcium carbonate, about 6500 parts per million, was used in the test system (1 gram solid calcium carbonate was added).

Similarly, in a separate test, 1 gram of fatty acid salt mixture was added to the burkeite system. This mixture comprised 0.5 gram sodium oleate and 0.5 gram sodium stearate. The level of fatty acid in the test system was 6500 parts per million, which is considered to be a high level also.

In a third test, 1 gram of an industrial black liquor sample was added to a burkeite system as decribed in Example 2. Since the system, before addition of black liquor, was already supersaturated with burkeite, the conditions of the third test were also considered to be quite severe.

Results of the soft scale inhibition tests in the presence of solid calcium carbonate, fatty acids and black liquor are presented below in terms of percent (%) inhibition versus a control run. The treatment levels were all 200 parts per million.

TABLE 5

| Constituent Added to Burkeite System | Treatment | % Inhibition |
|---|---|---|
| Black liquor | PAA (M.W. = 1,500) | 18 |
| | PAA (M.W. = 5,000) | 51 |
| | PAA (M.W. = 100,000) | 90 |
| Fatty acid | PAA (M.W. = 1,500) | 60 |
| | PAA (M.W. = 5,000) | 76 |
| | PAA (M.W. = 100,000) | 52 |
| Solid Calcium Carbonate | PAA (M.W. = 1,500) | 36 |
| | PAA (M.W. = 5,000) | 23 |
| | PAA (M.W. = 100,000) | 35 |

As can be seen from Table 5, while the polymer was tested under unusually severe conditions, it still demonstrated soft scale inhibition efficacy. In veiw of the test conditions, this efficacy was considered to be quite impressive. To mitigate the effects of the fatty acid on the treatment, it is recommended that the polymer be fed to black liquor after the soap skimmer. It is also preferred that the treatment be added as an aqueous solution.

Having thus described our invention, we claim:

1. A method for inhibiting the precipitation of soft scale in a paper mill black liquor system prone to soft scale precipitation, which method comprises adding to said black liquor an effective amount of water-soluble polyacrylic acid.

2. A method according to claim 1, wherein said polyacrylic acid is added in an amount of from about 1 to about 500 parts per million parts of aqueous medium.

3. A method according to claim 2, wherein said soft scale comprises burkeite.

4. A method according to claim 3, wherein said polyacrylic acid is added to said black liquor in a multiple-effect evaporator.

5. A method according to claim 4, wherein said polyacrylic acid has a molecular weight of from about 500 to 1,000,000.

6. A method according to claim 5, wherein said polyacrylic acid has a molecular weight of from about 1,500 to 100,000.

7. A method according to claim 4, wherein said polyacrylic acid is added as an aqueous solution.

8. A method according to claim 7, wherein said polyacrylic acid has a molecular weight of from about 5,000 to 100,000.

9. A method according to claim 4 or 8, wherein said soft scale further comprises thenardite and thermonatrite.

10. A method for inhibiting the precipitation of soft scale in a paper mill black liquor system prone to soft scale precipitation, which method comprises adding to said black liquor an effective amount an additive consisting essentially of water soluble polyacrylic acid.

11. A method according to claim 10, wherein said additive is an aqueous solution.

* * * * *